US008487171B2

(12) United States Patent
Groerzinger et al.

(10) Patent No.: US 8,487,171 B2
(45) Date of Patent: Jul. 16, 2013

(54) FOOT MACHINE FOR A BASS DRUM OF A DRUM KIT

(75) Inventors: Thomas Groerzinger, Gehrden (DE); Roy Diers, Burgwedel (DE); Patrick Oelkers, Springe (DE)

(73) Assignee: Nass Magnet GmbH, Hannover (DE)

( * ) Notice: Subject to any disclaimer, the term of this patent is extended or adjusted under 35 U.S.C. 154(b) by 120 days.

(21) Appl. No.: 13/018,822

(22) Filed: Feb. 1, 2011

(65) Prior Publication Data

US 2011/0197738 A1 Aug. 18, 2011

(30) Foreign Application Priority Data

Feb. 15, 2010 (DE) ..... 20 2010 002 375 U

(51) Int. Cl.
*G10D 13/02* (2006.01)

(52) U.S. Cl.
USPC ..... 84/422.1

(58) Field of Classification Search
USPC ..... 84/411 R, 422.1, 422.2, 422.3
See application file for complete search history.

(56) References Cited

U.S. PATENT DOCUMENTS

2006/0060062 A1 3/2006 Dyk
2009/0235806 A1* 9/2009 Chen ..... 84/422.1

FOREIGN PATENT DOCUMENTS

CN 292173 10/1953
DE 2905845 A1 8/1980

OTHER PUBLICATIONS

German Search Report for DE 20 2010 002 375.0.

* cited by examiner

*Primary Examiner* — Kimberly Lockett
(74) *Attorney, Agent, or Firm* — Renner Kenner Greive Bobak Taylor & Weber

(57) ABSTRACT

The foot machine according to the invention for a bass drum of a drum kit basically comprises a shaft mounted rotatably in a frame, a beater supported on the shaft, and a pedal connected to the beater, operation of the pedal bringing about an excursion of the beater. Also provided are permanent magnet restoring means which bring the displaced beater back into a resting position and which are formed by at least one inner and at least one outer permanent magnet arrangement arranged concentrically around the shaft.

10 Claims, 8 Drawing Sheets

FOOT MACHINE FOR A BASS DRUM OF A DRUM KIT

TECHNICAL FIELD

The invention relates to a foot machine for a bass drum of a drum kit.

BACKGROUND OF THE INVENTION

The foot machine is used to play the bass drum of the drum kit with the foot. It basically comprises a beater which is supported on a shaft and which is connected to a pedal, operation of the pedal bringing about an excursion of the beater. The pedal is for that purpose connected to the beater, for example, by way of a chain or a leather belt. Restoring means which bring the displaced beater back into a resting position and which are normally formed by an adjustable spring member are also provided.

However, owing to the use of mutually contacting components, that construction is disadvantageous with regard to wear and noise development. Furthermore, depending on the type of cylindrical springs used, these usually being metallic, the evolution of forces is substantially linear around the resting position of the pedal, it being possible to adjust the resting position by means of eccentrics. However, the linear evolution of forces has the drawback that the restoring movement does not take place quickly enough.

JP-A 09 7203022 discloses a foot machine for a drum kit which uses permanent magnet restoring means in order to bring the displaced beater back into its resting position. However, the disadvantage of that invention is that the variable arrangement of the restoring means which is necessary in order to influence the restoring forces is achieved only with great expenditure. In addition, owing to the open arrangement of the restoring means, there is a risk of damage or impairment as a result of soiling.

SUMMARY OF THE INVENTION

The object of the invention is to provide a foot machine which is distinguished by an operation which is as free from friction and noise as possible. Furthermore, restoration into the resting position is to take place as dynamically as possible.

That object is achieved according to the invention by the features of claim 1.

The foot machine according to the invention for a bass drum of a drum kit basically comprises a shaft mounted rotatably in a frame, a beater supported on the shaft, and a pedal connected to the beater, operation of the pedal bringing about an excursion of the beater. Also provided are permanent magnet restoring means which bring the displaced beater back into a resting position and which are formed by at least one inner and at least one outer permanent magnet arrangement arranged concentrically around the shaft.

The concentric arrangement of the permanent magnet arrangements enables the beater to be operated with low friction and low noise. In addition, restoration into the resting position takes place highly dynamically.

Further configurations of the invention are the subject-matter of the subordinate claims.

According to one configuration of the foot machine, one of the two permanent magnet arrangements is arranged in a rotationally secure manner on the shaft, while the other permanent magnet arrangement is mounted on the frame, the inner permanent magnet arrangement preferably being arranged in a rotationally secure manner on the shaft while the outer permanent magnet arrangement is mounted on the frame.

The permanent magnet arrangement mounted on the frame is received there in a rotatable manner and can be fixed in a desired position on the frame. The resting position of the beater can be adjusted by rotating the permanent magnet arrangement mounted on the frame.

According to a preferred embodiment, the permanent magnet arrangements are constructed in the form of tube pieces and/or sleeves and may each comprise a magnet holder composed of a non-magnetic material, and at least one permanent magnet. In practice, however, each permanent magnet arrangement will have a plurality of permanent magnets.

According to a preferred configuration of the foot machine, an inner and an outer permanent magnet arrangement are provided on each of the two sides of the beater supported on the shaft. The resting position can be adjusted by a similar displacement of the two permanent magnet arrangements mounted on the frame. Moreover, it is possible to adjust or alter the restoring force by a different displacement of the two permanent magnet arrangements mounted on the frame.

BRIEF DESCRIPTION OF THE DRAWINGS

Further advantages and configurations of the invention will be explained in more detail by means of the following description and the drawings.

In the Drawings

DETAILED DESCRIPTION OF THE INVENTION

Figure 1:
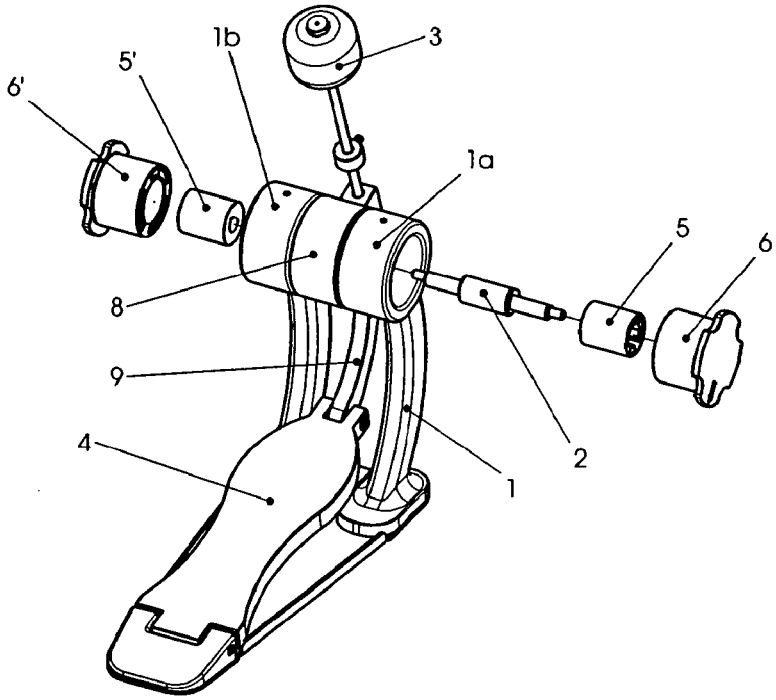
FIG. 1 is a three-dimensional exploded view of the foot machine according to the invention.
Figure 2:
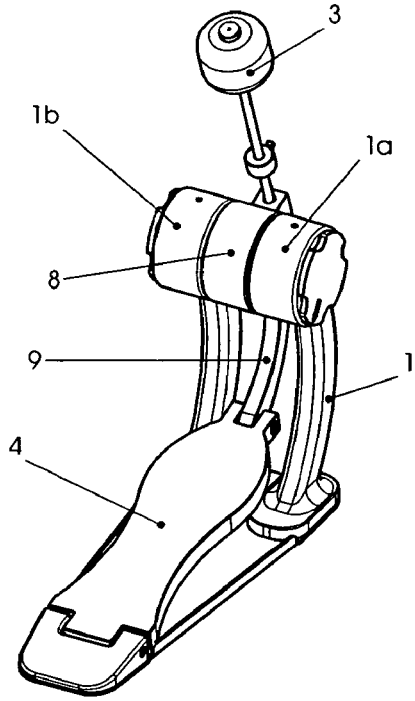
FIG. 2 is a three-dimensional view of the foot machine according to the invention.

The foot machine shown in FIGS. 1 and 2 for a bass drum of a drum kit basically comprises a shaft 2 mounted rotatably in a frame 1, a beater 3 supported on the shaft, and a pedal 4 connected to the beater. By treading on the pedal 4, the beater 3 is caused to perform an excursion about the shaft 2 and is struck against the skin of a drum (not shown).

Also provided are permanent magnet restoring means which bring the displaced beater 3 back into its resting position and which are formed by two inner permanent magnet arrangements 5, 5' and two outer permanent magnet arrangements 6, 6', one inner and one outer permanent magnet arrangement being slipped onto the shaft 2 from each of the two sides so that the permanent magnet arrangements are arranged concentrically around the shaft 2. The permanent magnet arrangements 5, 6 and 5', 6' are for that purpose constructed in the form of tube pieces and/or sleeves.

The frame 1 has two sleeve-like receiving members 1*a*, 1*b*, the inside diameter of which is only slightly larger than the outside diameter of the outer permanent magnet arrangements 6, 6', so that the outer permanent magnet arrangements are held with as little clearance as possible in the receiving members 1*a* and 1*b* in such a manner that a rotation of the outer permanent magnet arrangements relative to the receiving members is possible. The outer permanent magnet arrangements 6, 6' can be locked in a rotationally secure manner in the receiving members 1*a*, 1*b* of the frame 1 by means of locking members 7*a* and 7*b* which are indicated only schematically and which are, for example, in the form of square-head screws.

Figure 3:
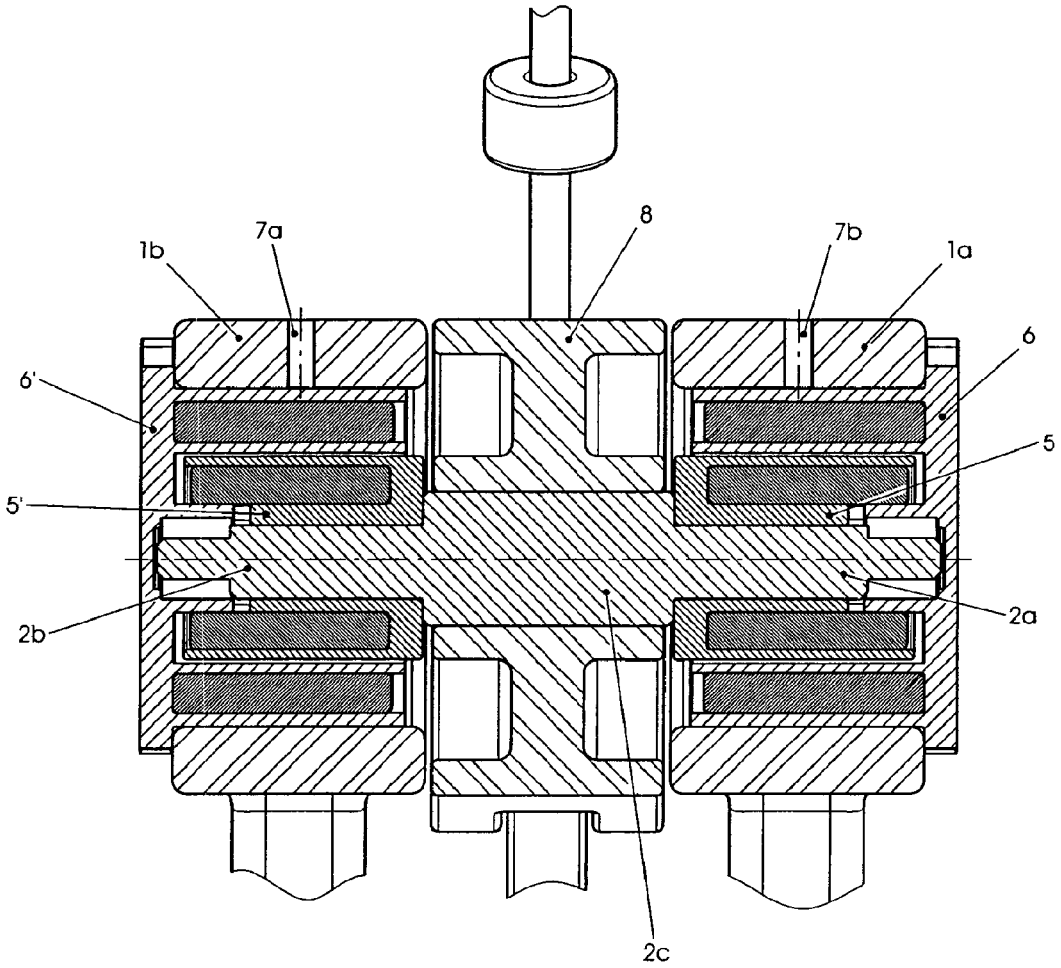
FIG. 3 is a sectional view along the shaft.
Figure 4A:
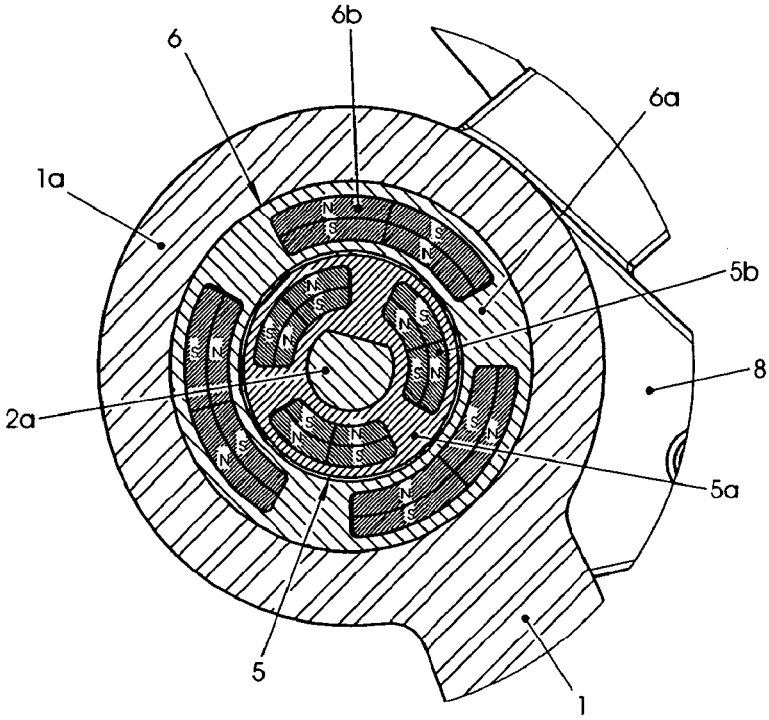
FIG. 4*a* is a sectional view of the permanent magnet arrangements in the resting position according to a first embodiment.

The inner permanent magnet arrangements 5, 5' are in turn supported in the outer permanent magnet arrangements 6, 6' with only slight clearance, as can also be seen especially from FIG. 3. Furthermore, the inner permanent magnet arrangements 5, 5' are arranged in a rotationally secure manner on the ends 2*a* and 2*b* of the shaft 2. This can be effected, for example, by means of a suitable press fit or a flattened region, as shown in FIG. 4*a*.

In a central region 2*c* of the shaft 2, a beater holder 8 is also connected to the latter in a rotationally secure manner. The beater 3 is mounted on the beater holder 8 which is in turn connected to the pedal 4 by way of a flexibly coupled link rod 9.

Operation of the pedal 4 is therefore transmitted via the link rod 9 onto the beater holder 8 which is rotated together with the shaft 2 and in the process causes the beater 3 to perform an excursion. By means of the rotationally secure connection, a rotation of the shaft 2 also brings about a rotation of the inner permanent magnet arrangements 5, 5' relative to the outer permanent magnet arrangements 6, 6' arranged in a stationary manner in the frame.

The shaft 2 therefore carries the beater holder which is connected to it in a rotationally secure manner, and the inner and outer permanent magnet arrangements 5, 6 and 5', 6' form the two bearings for the shaft 2. This gives an extremely compact arrangement.

However, the inner and outer permanent magnet arrangements are not only used as bearings for the shaft 2, but they also constitute permanent magnet restoring means by which the displaced beater 3 is brought back into its resting position again as soon as the pressure is removed from the pedal. The structure and operation of the permanent magnet arrangements will be described in more detail hereinafter with reference to FIG. 4*a*.

The inner permanent magnet arrangement 5 comprises a magnet holder 5*a* and three permanent magnets 5*b* which are embedded in the non-magnetic material of the magnet holder 5*a*. The outer permanent magnet arrangement 6 is constructed analogously with a magnet holder 6*a* which is composed of a non-magnetic material and in which three permanent magnets 6*b* are again embedded. The inner and outer permanent magnet arrangements 5', 6' are constructed in the same manner.

Owing to the rotational mobility between the inner and outer permanent magnet arrangements 5, 6, the inner permanent magnet arrangement 5 together with the shaft 2 will be oriented in such a manner that opposing polarities of the inner permanent magnets 5*b* and the outer permanent magnets 6*b* are opposite each other. Since the permanent magnets are expediently arranged in such a manner that they are distributed uniformly over the circumference, the inner permanent magnets 5*b* will be arranged between the outer permanent magnets 6*b* (see FIG. 4*a*), the weight of the beater possibly giving rise to deviations.

Figure 4B:
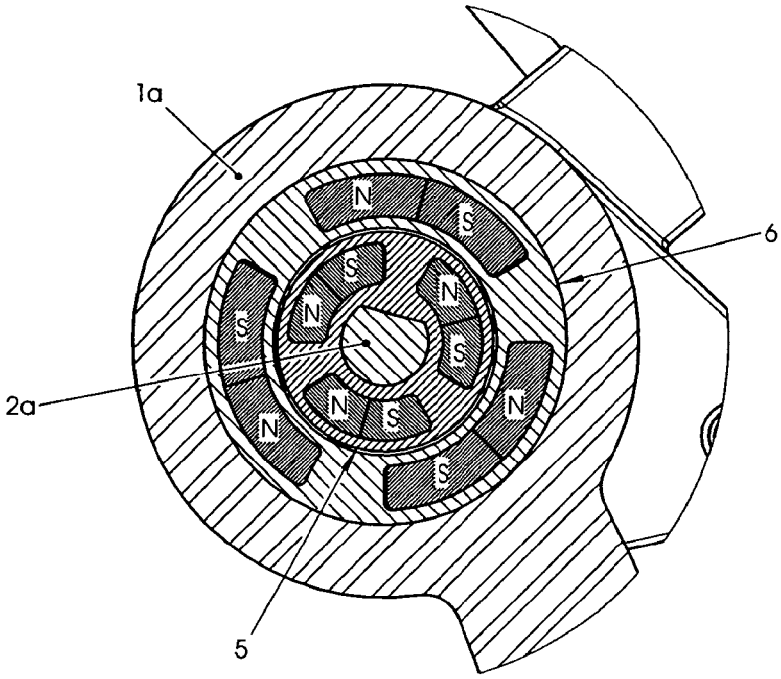
FIG. 4*b* is a sectional view of the permanent magnet arrangements in the resting position according to a second embodiment.
Figure 5:
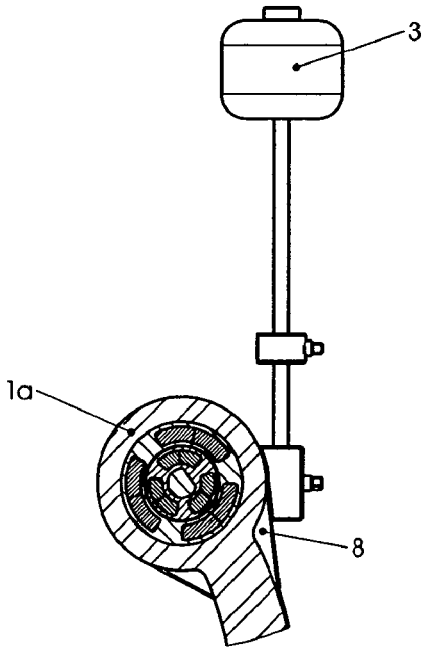
FIG. 5 is a sectioned partial view of the foot machine in a displaced position of the beater.

FIG. 4*b* shows a second embodiment of the inner and outer permanent magnet arrangements 5, 6 which differs only by the polarisation of the permanent magnets. Thus, a higher magnetic force can be achieved with the double-layered construction according to FIG. 4*a*. Instead of three permanent magnets for each permanent magnet arrangement, a higher or lower number can of course also be used. This results in structural features which can be used to influence the installation space and/or the power of the restoring means. In the two embodiments shown, the permanent magnets are arranged in a homopolar manner. In the context of the invention, however, an opposite-pole arrangement would of course also be possible.

In addition to the very compact form of the permanent magnet arrangements, which perform both the function of supporting the shaft and the function of restoring the beater, very simple alteration of the resting position and the restoring force is also possible.

Figure 6:
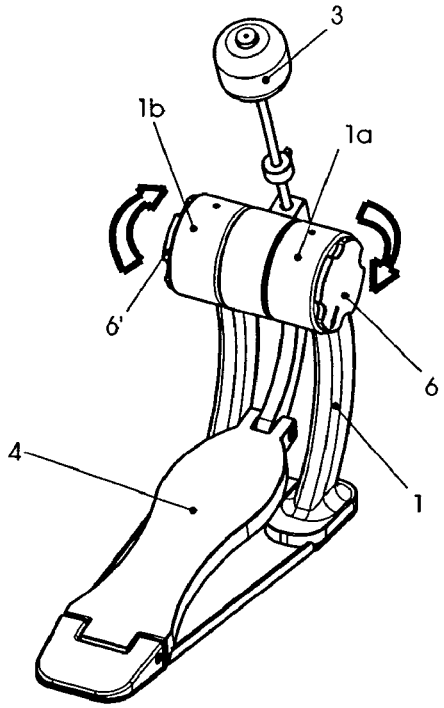
FIG. 6 is a three-dimensional view of the foot machine according to the invention with displacement of the resting position.
Figure 7A:
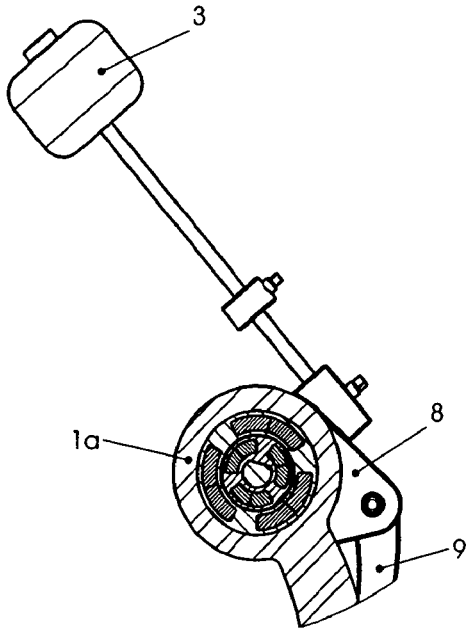
FIG. 7*a* is a sectioned partial view of the foot machine in a first resting position.
Figure 7B:
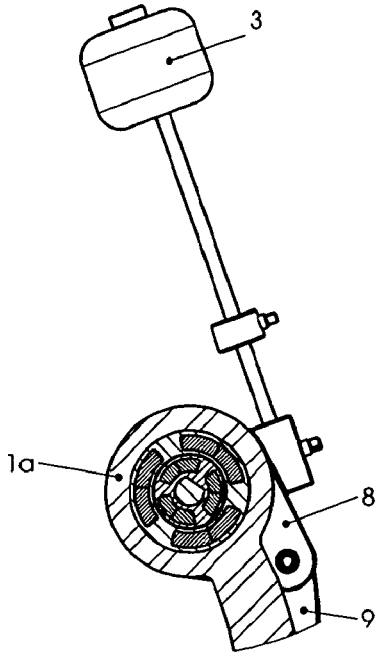
FIG. 7*b* is a sectioned partial view of the foot machine in a second resting position.

The resting position defines the distance from the beater 3 to the skin of the drum. Two different resting positions are shown in FIGS. 7*a* and 7*b*. The resting position is altered in a very simple manner by first of all loosening the two locking members 7*a*, 7*b* in order subsequently to rotate the two outer permanent magnet arrangements 6, 6' in the same direction of rotation and at the same angle of rotation in the receiving members 1*a* and 1*b*, as indicated in FIG. 6. To that end, it is advantageous if the outer permanent magnet arrangement is constructed in the manner of a turning handle at its outer ends, as emerges in particular from FIG. 1. After the adjustment, the position is fixed again by means of the locking members 7*a*, 7*b*. The distance from the beater to the drum can thus be adapted to the drummer's preferences or to the requirements of the piece of music.

Figure 8:
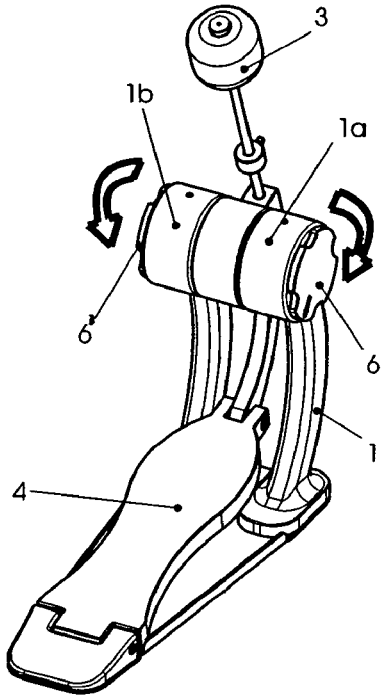
FIG. 8 is a three-dimensional view of the foot machine according to the invention with adjustment of the restoring force.
Figure 9A:
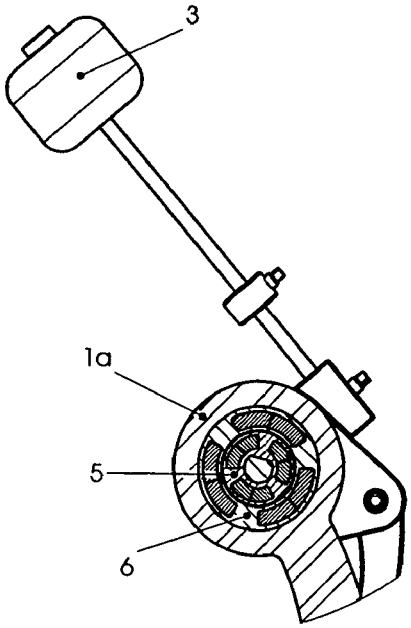
FIG. 9*a* is a sectional view of the first permanent magnet arrangements in a first adjustment of the restoring force.
Figure 9B:
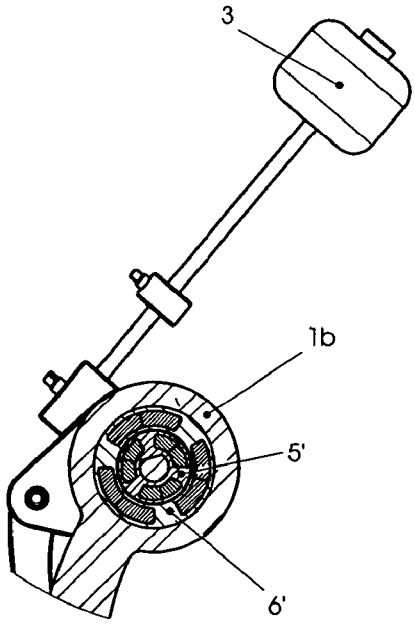
FIG. 9*b* is a sectional view of the second permanent magnet arrangements in the first adjustment of the restoring force.

Irrespective of the adjustment of the resting position, it is, however, also possible to alter the force restoring the beater from the displaced position into the resting position. For that purpose, the two outer permanent magnet arrangements 6, 6' according to FIG. 8 are to be rotated in opposite directions. The resultant difference can be seen by comparing FIGS. 9*a* and 9*b* with FIGS. 10*a* and 10*b*. FIGS. 9*a* and 9*b* show the position of the two permanent magnet arrangements 5, 6 and 5', 6' in which the two inner permanent magnet arrangements 5, 5' are arranged exactly between the outer permanent magnet arrangements 6, 6'. In that position, it is possible to set the smallest restoring force.

Figure 10A:
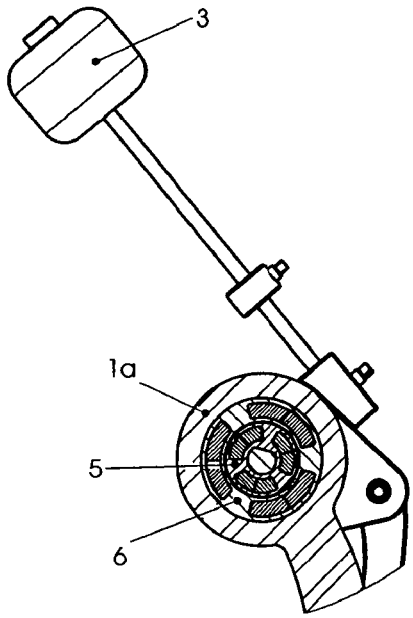
FIG. 10*a* is a sectional view of the first permanent magnet arrangements in a second adjustment of the restoring force and FIG. 10*b* is a sectional view of the second permanent magnet arrangements in a second adjustment of the restoring force.
Figure 10B:
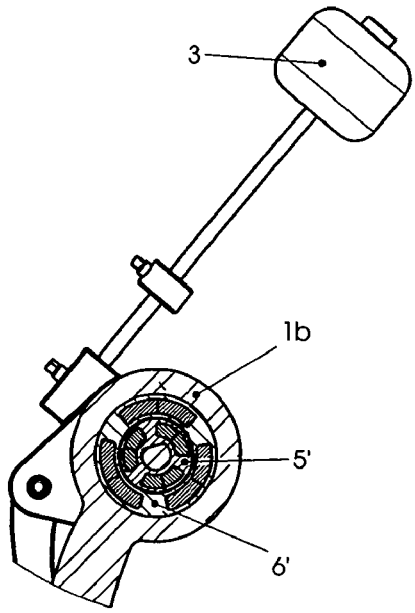

If the two outer permanent magnet arrangements 6, 6' are rotated in opposite directions in the sense of the arrows shown in FIG. 8, this results, for example, in the position shown in FIGS. 10*a* and 10*b*. That position results in a greater restoring force.

The change to the restoring force may result in a shifting of the resting position. After the restoring force has been adjusted, the resting position can be corrected to the desired distance again by displacing the two outer permanent magnet arrangements in the same direction of rotation and at the same angle of rotation. It is important only that there is no further displacement of the position of the two outer permanent magnet arrangements 6, 6' relative to each other.

The invention claimed is:

1. Foot machine for a bass drum of a drum kit, having a. a shaft mounted rotatably in a frame, b. a beater supported on the shaft, c. a pedal connected to the beater, operation of the pedal bringing about an excursion of the beater and d. permanent magnet restoring means which bring the displaced beater back into a resting position, characterised in that the permanent magnet restoring means are formed by at least one inner and at least one outer permanent magnet arrangement arranged concentrically around the shaft.

2. Foot machine according to claim 1, characterised in that one of the two permanent magnet arrangements is arranged in a rotationally secure manner on the shaft, while the other permanent magnet arrangement is mounted on the frame.

3. Foot machine according to claim 1, characterised in that the inner permanent magnet arrangement is arranged in a rotationally secure manner on the shaft, while the outer permanent magnet arrangement is mounted on the frame.

4. Foot machine according to claim 2, characterised in that the permanent magnet arrangement mounted on the frame is received there in a rotatable manner and is fixable in a desired position on the frame.

5. Foot machine for a bass drum of a drum kit, having a. a shaft mounted rotatably in a frame, b. a beater supported on the shaft, c. a pedal connected to the beater, operation of the pedal bringing about an excursion of the beater and d. permanent magnet restoring means which bring the displaced beater back into a resting position, characterised in that the permanent magnet restoring means are formed by at least one inner and at least one outer permanent magnet arrangement arranged concentrically around the shaft, and further characterised in that the permanent magnet arrangements are constructed in the form of tube pieces or sleeves.

6. Foot machine according to claim 1, characterised in that the permanent magnet arrangements each comprise a magnet holder composed of a non-magnetic material, and at least one permanent magnet.

7. Foot machine according to claim 1, characterised in that each permanent magnet arrangement has a plurality of permanent magnets.

8. Foot machine according to claim 1, characterised in that an inner and an outer permanent magnet arrangement is provided on each of the two sides of the beater supported on the shaft.

9. Foot machine according to claim 2, characterised in that the resting position of the beater is adjustable by rotating the permanent magnet arrangement mounted on the frame.

10. Foot machine according to claim 1 for a bass drum of a drum kit, having a. a shaft mounted rotatably in a frame, b. a beater supported on the shaft, c. a pedal connected to the beater, operation of the pedal bringing about an excursion of the beater and d. permanent magnet restoring means which bring the displaced beater back into a resting position, characterised in that the permanent magnet restoring means are formed by at least one inner and at least one outer permanent magnet arrangement arranged concentrically around the shaft, and further characterised in that two inner and two outer permanent magnet arrangements are provided, in each case one inner and one outer permanent magnet arrangement cooperating with each other, and an adjustment of the resting position being effected by a similar displacement of the two permanent magnet arrangements mounted on the frame, while an adjustment of the restoring force is effected by a different displacement of the two permanent magnet arrangements mounted on the frame.

* * * * *